US007819987B2

(12) United States Patent
Fujita et al.

(10) Patent No.: US 7,819,987 B2
(45) Date of Patent: Oct. 26, 2010

(54) ANTIGEN EXPOSURE CHAMBER AND METHOD OF CLEANING AND DRYING THE SAME

(75) Inventors: Toshio Fujita, Tokyo (JP); Huaipeng Tang, Tokyo (JP); Akihiro Seta, Tokyo (JP); Minoru Okuda, Machida (JP); Kazuhiro Hashigucci, Yokohama (JP); Kimihiro Okubo, Tokyo (JP)

(73) Assignee: Shinryo Corporation, Tokyo (JP)

( * ) Notice: Subject to any disclaimer, the term of this patent is extended or adjusted under 35 U.S.C. 154(b) by 432 days.

(21) Appl. No.: 12/088,516

(22) PCT Filed: Sep. 28, 2005

(86) PCT No.: PCT/JP2005/017867

§ 371 (c)(1),
(2), (4) Date: Mar. 28, 2008

(87) PCT Pub. No.: WO2007/037002

PCT Pub. Date: Apr. 5, 2007

(65) Prior Publication Data

US 2009/0145466 A1 Jun. 11, 2009

(51) Int. Cl.
*B08B 3/04* (2006.01)

(52) U.S. Cl. ..... 134/166 R

(58) Field of Classification Search ..... 134/166 R
See application file for complete search history.

(56) References Cited

U.S. PATENT DOCUMENTS 3,046,163 A * 7/1962 Kearney et al. ..... 134/11
3,755,826 A * 9/1973 Roberts ..... 4/662
5,074,238 A * 12/1991 Telchuk et al. ..... 118/326

FOREIGN PATENT DOCUMENTS

| | | | |
|---|---|---|---|
| JP | 05-248678 | * | 9/1993 |
| JP | 11-083386 | | 3/1999 |
| JP | 2004-275881 | | 10/2004 |

OTHER PUBLICATIONS

Machine translation of JP05-248678 (Sep. 1993).*

Krug, N. et al., "Validation of an enviormental exposure unit for controlled human inhalation studies with grass pollen in patients with seasonal allergic rhinitis." Clin. Exp Allergy., 2003, vol. 33, No. 12, p. 1667-1674.

* cited by examiner

*Primary Examiner*—Michael Cleveland
*Assistant Examiner*—Samuel A Waldbaum
(74) *Attorney, Agent, or Firm*—Browdy and Neimark, PLLC

(57) ABSTRACT

An antigen exposure chamber for quickly performing cleaning and drying with high quality is provided. The antigen exposure chamber of the present invention includes: a cleaning water supply device for supplying cleaning water for cleaning the antigen exposure chamber; cleaning nozzles for jetting the cleaning water supplied from the cleaning water supply device into the antigen exposure chamber and ducts of fan units to clean the antigen exposure chamber and the ducts; a floor surface of the antigen exposure chamber; and an exhaust device provided below the floor surface to exhaust air from the floor surface of the antigen exposure chamber and collect and drain the cleaning water during cleaning.

3 Claims, 3 Drawing Sheets

DETAIL AROUND AIR EXHAUST PORT

ANTIGEN EXPOSURE CHAMBER AND METHOD OF CLEANING AND DRYING THE SAME

TECHNICAL FIELD

The present invention relates to an antigen exposure chamber which can be quickly cleaned and dried after use, and a method of cleaning and drying the same.

BACKGROUND ART

For experiments and researches on diseases such as allergies, antigen exposure chambers are used which include antigen exposure chambers for supplying predetermined amounts of antigens to be exposed to subjects. Generally, in experiments and so on for identifying the causes of allergies, such antigen exposure chambers are used while antigen types are changed. Therefore, cleaning is necessary inside and outside of the antigen exposure chambers after use.

However, conventional antigen exposure chambers are not provided with special cleaning devices or cleaning facilities and thus have been cleaned by hand. Therefore, it takes a long time to clean conventional antigen exposure chambers and only insufficient cleaning can be performed.

Patent Document 1: None

Non-patent Document 1: None

DISCLOSURE OF THE INVENTION

Problem to be Solved by the Invention

In view of the present circumstances of conventional antigen exposure chambers, an object of the present invention is to provide an antigen exposure chamber which includes a water cleaning device and is devised in various ways for cleaning and drying performed after cleaning with high cleaning and drying efficiency, and a method of cleaning and drying the same.

Means for Solving the Problem

In order to attain the object, in the present invention, an antigen exposure chamber includes an outdoor air diffuser provided on the ceiling surface of the antigen exposure chamber to supply an antigen from the ceiling surface of the antigen exposure chamber to the inside of the antigen exposure chamber such that the antigen is mixed with outdoor air; a fan unit including a supply port and a suction port on each of the four corners of the antigen exposure chamber to provide a circulating flow of air flowing with circulation in the horizontal direction in the antigen exposure chamber; a cleaning water supply device for supplying cleaning water for cleaning the antigen exposure chamber; a cleaning nozzle connected to the cleaning water supply device and arranged to jet the cleaning water supplied from the cleaning water supply device, into the antigen exposure chamber and the ducts of the fan units to clean the antigen exposure chamber and the ducts; a floor surface of the antigen exposure chamber; and an exhaust device provided below the floor surface to exhaust air from the floor surface of the antigen exposure chamber and collect and drain the cleaning water during cleaning.

Further, the cleaning water supply device preferably includes a water purifying device for purifying tap water; a pure water tank for storing the purified water; and a pure water supply pump for pumping the pure water from the pure water tank into the cleaning nozzle.

Moreover, the floor surface is preferably made up of a plurality of arranged porous plate floors, and the exhaust device preferably includes an air exhaust port disposed below the porous plate floors to exhaust air from the antigen exposure chamber; drain pans disposed so as to surround the air exhaust port and receive and collect the cleaning water flowing down from the antigen exposure chamber; a drain tank connected to the drain pans to store the cleaning water collected by the drain pans; a drain pump connected to the drain tank to drain the cleaning water stored in the drain tank into a drain pipe; a drying exhaust-air fan connected to the drain tank and arranged to exhaust the air from the antigen exposure chamber through the drain tank to accelerate drying in the antigen exposure chamber after the cleaning water is drained; and an odor backflow preventing exhaust-air fan connected to the drain tank and arranged to exhaust air from the drain tank to prevent backflow of odor in the drain tank during exposure to the antigen in the antigen exposure chamber.

The porous plate floors composing the floor surface are preferably arranged side by side with intervals of 3 mm to 6 mm therebetween because water droplets are hard to stay between the porous plate floors.

The drain pan preferably has an inner surface coated with a hydrophilic agent because no water droplets and the like are left.

The antigen exposure chamber is cleaned and dried as follows: first, tap water is purified, the purified water is stored in the pure water tank, the pure water is pumped from the pure water tank to the cleaning nozzle by the pure water supply pump, the pure water supplied from the pure water supply pump is jetted into the antigen exposure chamber and the ducts of the fan units to clean the antigen exposure chamber and the ducts, the pure water having been used for cleaning and flown down from the floor surface of the antigen exposure chamber is collected below the floor surface of the antigen exposure chamber, is stored in the drain tank, and is drained from the drain tank to the drain pipe by the drain pump, and then the antigen exposure chamber is dried by exhausting air from the antigen exposure chamber through the drain tank after the pure water having been used for cleaning is drained.

EFFECTS OF THE INVENTION

With the configuration of the antigen exposure chamber and the cleaning and drying method mentioned above, the present invention makes it possible to automatically perform extremely high-speed cleaning and drying with high quality.

| Description of Symbols | |
|---|---|
| 1, 1' | antigen exposure chamber |
| 2 | outdoor air diffuser |
| 3 | antigen |

-continued

| Description of Symbols | |
|---|---|
| 4 | air exhaust port |
| 5 | supply air filter unit |
| 6 | exhaust air filter unit |
| 7 | pre-air filter |
| 8 | medium-efficiency air filter |
| 9 | air supply fan |
| 10 | heater |
| 10' | activated carbon filter |
| 11 | HEPA filter |
| 12 | medium-efficiency air filter |
| 13 | exhaust air fan |
| 14 | drain pan |
| 15 | porous plate floor |
| 16 | fan unit |
| 17 | circulating air flow duct |
| 18 | sampling tube |
| 19 | water purifying device |
| 20 | pure water tank |
| 21 | pure water supply pump |
| 22 | water supply pipe |
| 23 | antigen exposure chamber cleaning nozzle |
| 24 | circulating air flow duct cleaning nozzle |
| 25 | solenoid valve |
| 26 | drain pipe |
| 27 | drain tank |
| 28 | drain pump |
| 29 | drying exhaust-air fan |
| 30 | odor backflow preventing exhaust-air fan |
| 31 | cleaning water entry preventing lid |
| 32 | outdoor air introduction duct |
| 33 | outdoor air introduction duct cleaning nozzle |

BEST MODE FOR CARRYING OUT THE INVENTION

Figure 1:
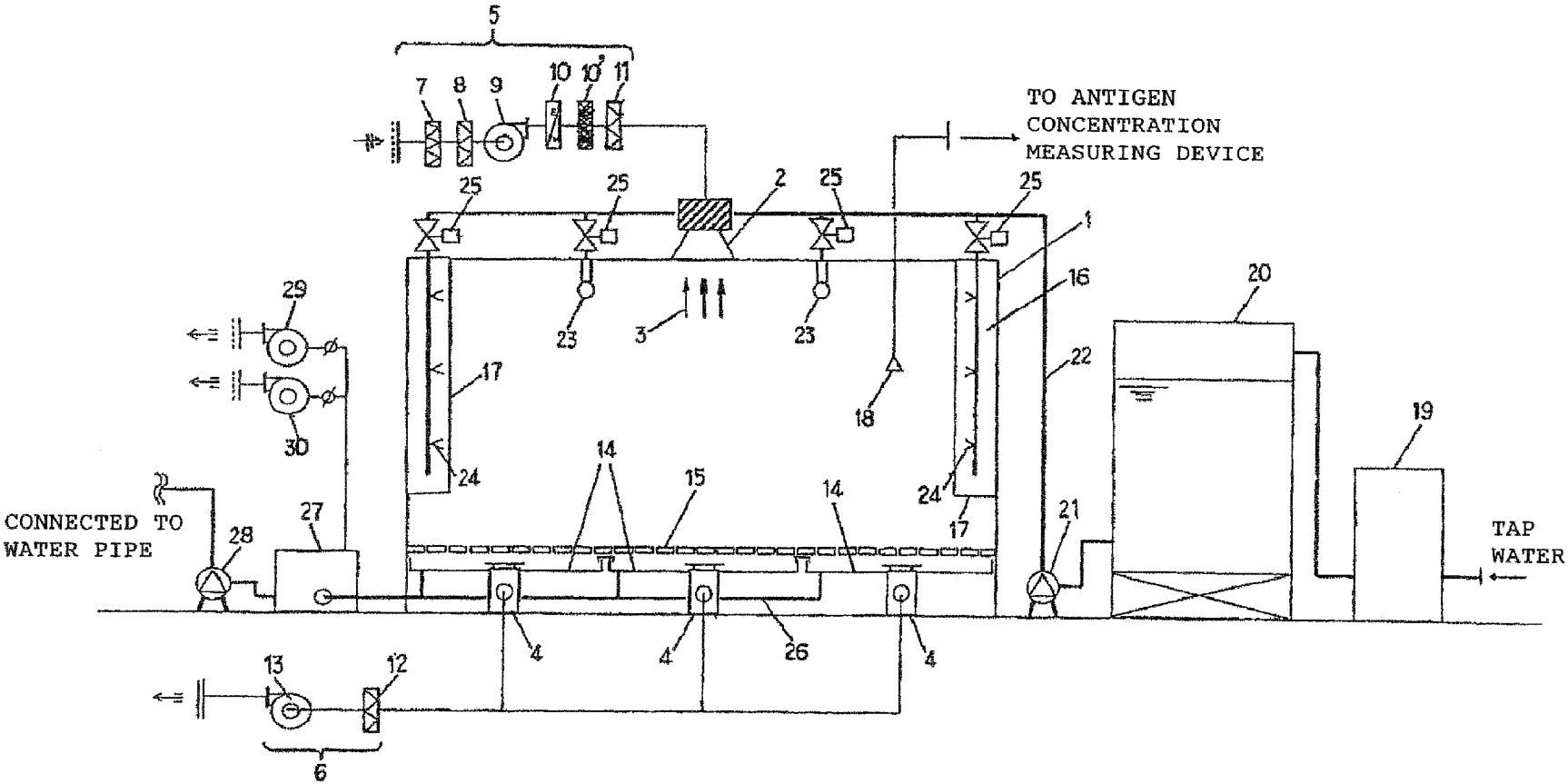
FIG. 1 is a side view showing the schematic configuration of an embodiment of an antigen exposure chamber according to the present invention.

FIG. 1 is a side view showing the configuration of an embodiment of an antigen exposure chamber according to the present invention. Broadly speaking, outdoor air supplied into an antigen exposure chamber 1 from an outdoor air diffuser 2 at the center of the ceiling is mixed with a specific antigen 3 by means of blowing of the antigen 3 that includes pollen, mites, and house dust and is supplied with a high concentration from an antigen supply device (not shown). The antigen exposure chamber 1 is filled with the air having been thus mixed with the antigen and the air is exhausted from air exhaust ports 4 provided on the floor of the antigen exposure chamber. The air is also exhausted from exhaust ports on drain pans 14 provided around the air exhaust ports 4.

The outdoor air is supplied to the outdoor air diffuser 2 through a supply air filter unit 5. The supply air filter unit 5 includes a pre-air filter 7, a medium-efficiency air filter 8, an air supply fan 9, a heater 10, an activated carbon filter 10', and a HEPA (high-efficiency particulate air) filter 11.

The air exhausted from the air exhaust ports 4 is exhausted through an exhaust air filter unit 6. The exhaust air filter unit 6 includes a medium-efficiency air filter 12 and an exhaust air fan 13. The air exhaust ports 4 are provided at the center of the chamber and on several points on the circumference of a circle whose center coincides with the center of the chamber. The floor of the antigen exposure chamber 1 is made up of a porous plate floor 15 disposed above the drain pans 14. The porous plate floor 15 is formed by arranging, side by side, a plurality of strip-like porous plates having a number of holes bored thereon.

The four corners of the antigen exposure chamber 1 have fan units 16. The fan unit 16 includes a circulating air flow duct 17 having an air suction port and an air supply port, and a circulating air flow fan (not shown). Through supply and suction of air by the rotations of the circulating air flow fans in the fan units 16, the overall antigen exposure chamber is evenly filled with an air flow containing an antigen and circulating in the antigen exposure chamber. The velocity of the circulating air flow is so suppressed that subjects in the chamber do not feel draft.

The air containing the antigen in the antigen exposure chamber 1 is partially supplied to an external antigen concentration measuring device (not shown) through a sampling tube 18 provided in the chamber, and the concentration of the antigen in the antigen exposure chamber is monitored and controlled by the antigen concentration measuring device installed outside the chamber.

The following is the arrangement of the cleaning facility of the antigen exposure chamber. First, tap water is supplied into a water purifying device 19 provided outside of the chamber and then is purified therein. The purified water is stored in a pure water tank 20. The pure water from the pure water tank 20 is jetted by a pure water supply pump 21 through a water supply pipe 22 from antigen exposure chamber cleaning nozzles 23 provided near the ceiling of the antigen exposure chamber 1, so that the inside of the antigen exposure chamber is cleaned. The cleaning nozzles are preferably autorotation omnidirectional jetting nozzles. Further, the pure water from the pure water tank 20 by the pure water supply pump 21 through the water supply pipe 22 is jetted from circulating air flow duct cleaning nozzles 24 provided in the circulating air flow ducts 17, so that the inside of the circulating air flow ducts 17 is cleaned. The antigen exposure chamber cleaning nozzles 23 and the circulating air flow duct cleaning nozzles 24 each include an solenoid valve 25 for electrically controlling the jetting of a cleaning solution. In this way, the inside of the antigen exposure chamber 1 and the inside of the circulating air flow ducts 17 are automatically cleaned with the pure water jetted from the cleaning nozzles. Cleaning with tap water leaves water stain and a large amount of pollen and the like flowing with cleaning water sticks to the water stain and cannot be washed away from the water stain, whereas in cleaning with pure water, no water stain is left and pollen and the like can be completely washed away. Thus cleaning with pure water is preferable.

The cleaning solution after cleaning passes through the holes of the porous plate floor 15, is collected in the drain pans 14, is collected through a drain pipe 26 into a drain tank 27 provided outside the chamber, and then is drained from the drain tank 27 to a drain pipe by a drain pump 28. The drain tank 27 is connected to a drying exhaust-air fan 29 which dries the exposure chamber by exhausting air and an odor backflow preventing exhaust-air fan 30 which exhausts air with a relatively small air flow rate so as to prevent the odor of the drain tank from flowing back to the chamber. During cleaning, the drying exhaust-air fan 29 is activated to exhaust the gas constituents of cleaning exhaust. After the inside of the chamber is cleaned and cleaning water is drained, drying is accelerated by exhausting the air. The antigen exposure chamber is dried by supply dry air into the antigen exposure chamber and exhausting the dry air. The dry air is also controlled by an outdoor air conditioning system such that the supply air temperature is fixed in a range from 40° C. to 60° C. during drying. An air flow rate during drying is larger than an air flow rate during exposure and is preferably more than twice the air flow rate during exposure. During a normal operation other than the cleaning of the antigen exposure chamber, the odor backflow preventing exhaust-air fan 30 is activated to prevent odor in the drain tank from flowing back to the chamber.

Figure 2:
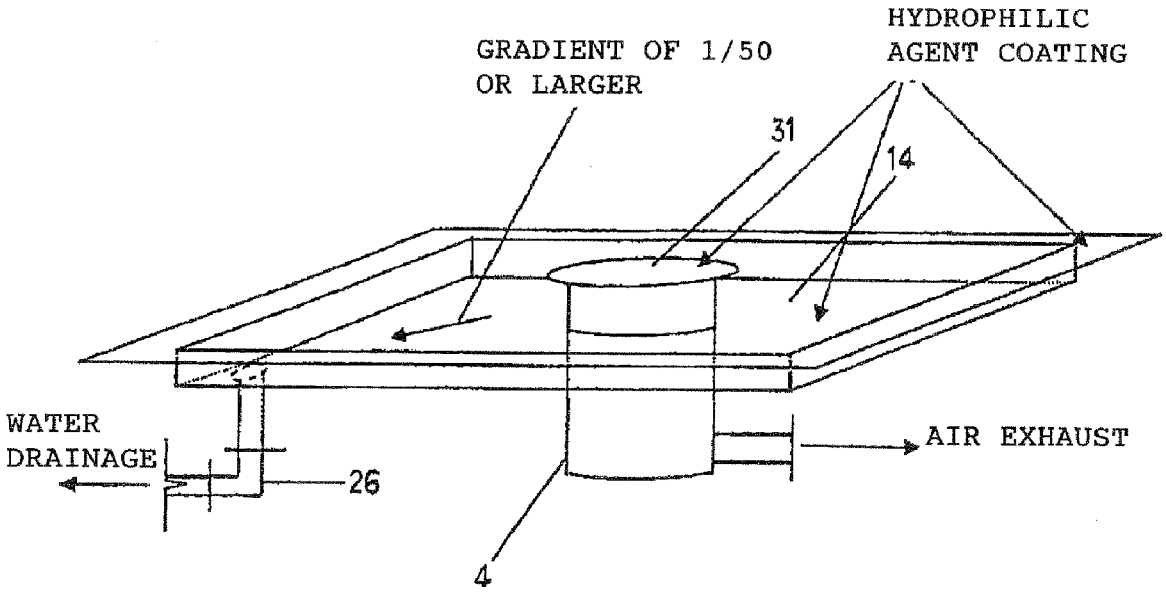
FIG. 2 is a perspective view showing the configuration of a drain pan and an air exhaust port according to the embodiment of FIGS. 1 and 2.
Figure 2:
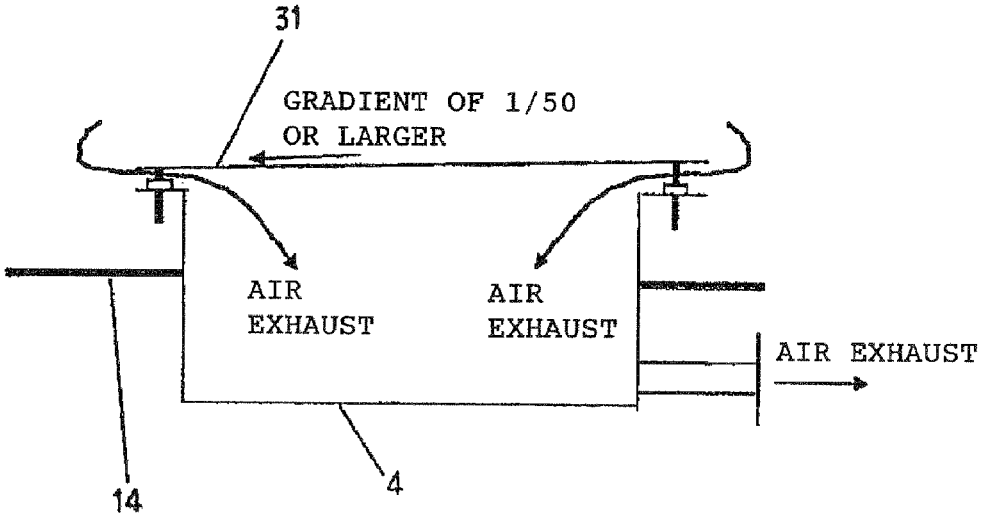

FIG. 2 is a perspective view showing the configuration of the drain pan 14 and the air exhaust port 4. As shown in FIG. 2, the drain pan 14 is tilted toward the drain pipe 26 with a gradient of 1/50 or larger to allow cleaning water to flow out. The air exhaust port 4 is formed by a cylindrical member that protrudes from the center of the drain pan 14 and has an upper open end. The upper open end of the air exhaust port 4 is closed by a cleaning water entry preventing lid 31 to prevent the entry of cleaning water with a clearance kept for exhaust. Further, a hydrophilic agent is applied to the inner concave portion of the drain pan 14. When the hydrophilic agent is not applied, small and large water droplets are formed and increase the drying time, whereas when the hydrophilic agent is applied, water droplets are not formed and thus drying is completed in a short time. The hydrophilic agent is applied not only to the internal side of the drain pan but also to the internal surface of the antigen exposure chamber. When the antigen exposure chamber has glass windows, surface treatment using a photocatalytic coating is preferable.

Moreover, in order to achieve short time cleaning, when the spacing between the porous plates 15 is excessively increased, a problem of strength and so on arises and when the spacing is excessively reduced, water remains between the porous plates like a bridge and causes a long drying time. An experimental result proves that a preferable interval between the porous plates is about 3 mm to 6 mm.

Figure 3:
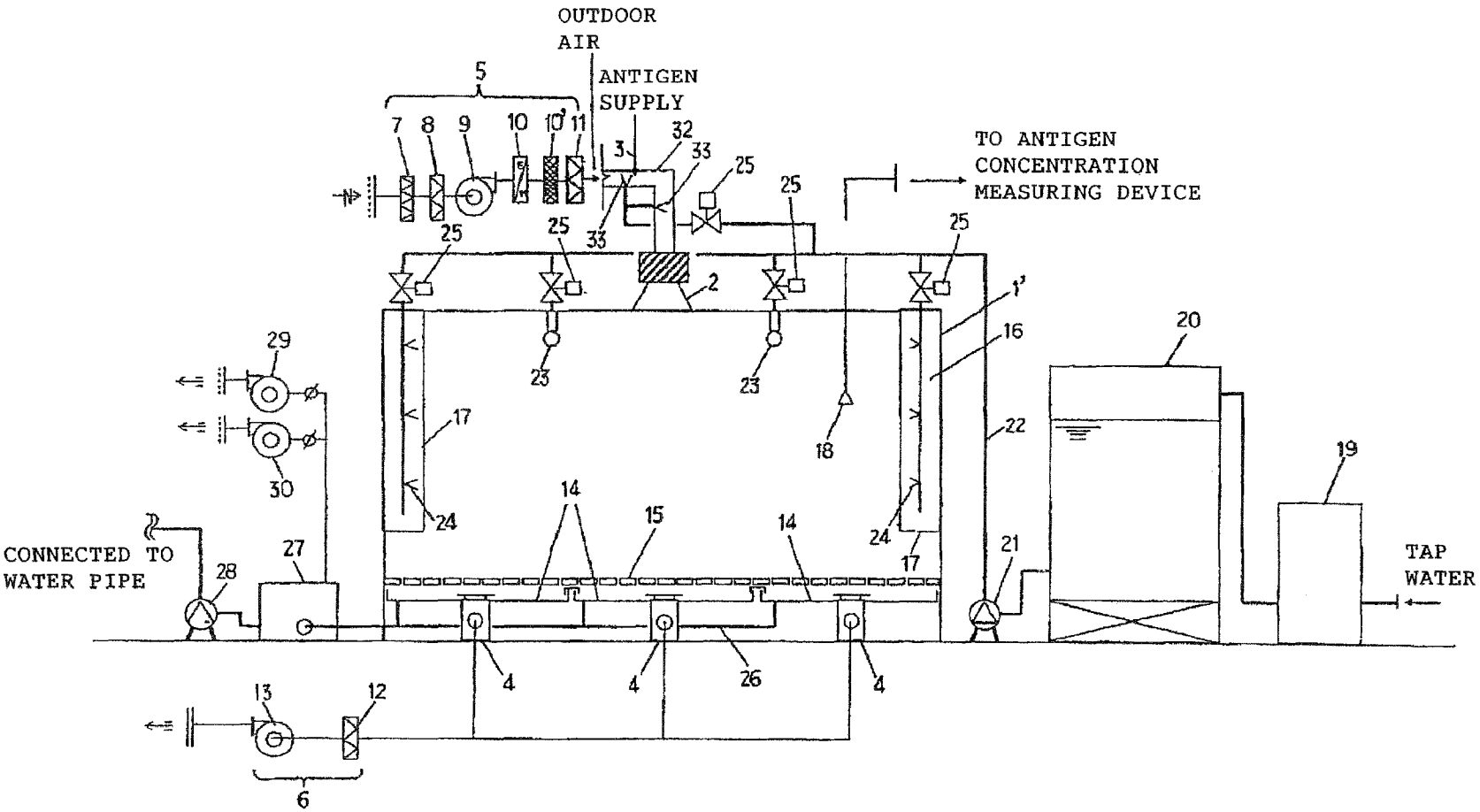
FIG. 3 is a side view showing the schematic configuration of another embodiment of an antigen exposure chamber according to the present invention.

FIG. 3 is a side view showing the configuration of another embodiment of an antigen exposure chamber according to the present invention. In the present embodiment, an antigen is supplied outside an antigen exposure chamber 1'. The antigen is supplied at the midpoint of an outdoor air introduction duct 32 for supplying outdoor air to a ceiling outdoor air diffuser 2. In this configuration, outdoor air introduction duct cleaning nozzles 33 are attached to the outdoor air introduction duct 32 from a water supply pipe 22 through solenoid valves 25, in addition to antigen exposure chamber cleaning nozzles 23 and circulating air flow duct cleaning nozzles 24. With this configuration, the inside of the chamber is cleaned and the inside of the outdoor air introduction duct is also cleaned at the same time.

The other configurations of the antigen exposure chamber 1' are identical to those of the antigen exposure chamber of FIG. 1 and thus are indicated by the same reference numerals as FIG. 1. The functions of the antigen exposure chamber 1' are similar to those of the antigen exposure chamber 1 of FIG. 1 and thus the explanation thereof is omitted.

With this configuration, the present invention makes it possible to automatically perform cleaning and drying with a water cleaning device in a short time with high efficiency and reliability, and to quickly prepare for subsequent use.

INDUSTRIAL APPLICABILITY

The antigen exposure chamber of the present invention was described in accordance with the foregoing embodiments. The present invention is not limited to these embodiments and can be changed and modified in various ways within the range of the technical idea of the present invention.

The invention claimed is:

1. An antigen exposure chamber, comprising:

a cleaning water supply device for supplying cleaning water for cleaning the antigen exposure chamber;

a cleaning nozzle connected to the cleaning water supply device and arranged to jet the cleaning water supplied from the cleaning water supply device, into the antigen exposure chamber and a duct of a fan unit to clean the antigen exposure chamber and the duct;

a floor surface of the antigen exposure chamber; and an exhaust device provided below the floor surface to exhaust air from the floor surface of the antigen exposure chamber and collect and drain the cleaning water during cleaning, wherein the floor surface is made up of a plurality of porous plate floors arranged side by side, and the exhaust device includes:

an air exhaust port disposed below the porous plate floors to exhaust air from the antigen exposure chamber;

drain pans disposed so as to surround the air exhaust port and receive and collect the cleaning water flowing down from the antigen exposure chamber;

a drain tank connected to the drain pans to store the cleaning water collected by the drain pans;

a drain pump connected to the drain tank to drain the cleaning water stored in the drain tank into a drain pipe;

a drying exhaust-air fan connected to the drain tank and arranged to exhaust air from the antigen exposure chamber through the drain tank to accelerate drying in the antigen exposure chamber after the cleaning water is drained; and an odor backflow preventing exhaust-air fan connected to the drain tank and arranged to exhaust air from the drain tank to prevent backflow of odor in the drain tank during exposure to an antigen in the antigen exposure chamber.

2. The antigen exposure chamber according to claim 1, wherein the porous plate floors composing the floor surface are arranged side by side with intervals of 3 mm to 6 mm.

3. The antigen exposure chamber according to claim 1, wherein the drain pan has an inner surface coated with a hydrophilic agent.

* * * * *